United States Patent [19]

Sasaki et al.

[11] Patent Number: 4,800,362

[45] Date of Patent: Jan. 24, 1989

[54] ORGANIC SOLVENT CLEANING APPARATUS

[75] Inventors: Noboru Sasaki, Toyota; Haruki Yamada, Nagoya; Yoshiaki Onchi, Kyoto; Kazuya Horio, Toyota, all of Japan

[73] Assignee: Toyota Jidosha Kabushiki Kaisha, Toyota, Japan

[21] Appl. No.: 13,137

[22] Filed: Feb. 10, 1987

[30] Foreign Application Priority Data

Feb. 10, 1986 [JP] Japan ..... 61-27714
Nov. 6, 1986 [JP] Japan ..... 61-264704

[51] Int. Cl.[4] ..... F26B 21/06
[52] U.S. Cl. ..... 340/78; 34/242
[58] Field of Search ..... 34/78, 242; 110/173 R

[56] References Cited

U.S. PATENT DOCUMENTS 4,238,122 12/1980 Snyder et al. ..... 34/78 X
4,389,797 6/1983 Spigarelli et al. ..... 34/78 X
4,394,802 7/1983 Spigarelli ..... 34/78 X
4,594,266 6/1986 Lemaire et al. ..... 34/242 X
4,628,616 12/1986 Shirai et al. ..... 34/78

*Primary Examiner*—Steven E. Warner
*Attorney, Agent, or Firm*—Finnegan, Henderson, Farabow, Garrett & Dunner

[57] ABSTRACT

An organic solvent cleaning apparatus has a cleaning chamber that is hermetically sealed by operating a door provided at its entrance and that is rendered full of an organic solvent vapor to effect a cleaning operation, and that is formed with an entrance in a side portion of the cleaning chamber. The cleaning chamber is equipped with vapor supply means capable of supplying the vapor only during the cleaning operation and with vapor collecting means, including cooling coils that are lowered to condense the vapor, for collecting the vapor after the cleaning operation. In one embodiment, this organic solvent cleaning apparatus has a vertically movable cover which in its descended position surrounds a material to be cleaned and creates a seal with a reservoir of liquid solvent at its lower end to prevent supplied vapor from leaking out.

10 Claims, 4 Drawing Sheets

ORGANIC SOLVENT CLEANING APPARATUS

BACKGROUND OF THE INVENTION

1. Field of the Invention

The present invention relates to a cleaning apparatus which uses an organic solvent, and more particularly, to a cleaning apparatus which uses the vapor of an organic solvent.

2. Description of the Prior Art

A cleaning method which employs an organic solvent is generally classified either as a dipping method (with the solvent at normal temperature or heated), wherein a material to be cleaned is dipped into the organic solvent, or as a vapor cleaning method, wherein the organic solvent vapor adheres to the material to be cleaned. In the case of the dipping method, when the material is pulled up from a liquid, even if the liquid overflows, oil constituents afloat on the liquids surface stick to the material. This contributes to not only deterioration of detergency, but also to difficulty in collecting solvent adhering to the material. Inevitably, this method increases the amount of solvent consumption. Moreover, with the heating process, heating of the total weight of the solvent is required, which leads to an unfavorable increase in consumption of thermal energy. Hence, the vapor cleaning method is widely used.

A wide variety of vapor cleaning devices (exemplified by Japanese Patent Laid-Open No. 9228/1984, Japanese Utility Model Laid-Open No. 109371/1977 and others) suitable for this method have heretofore been employed. However, such devices involve problems like high manufacturing and operating costs as well as low efficiency and a deteriorated working environment. An arrangement of a conventional apparatus, for example, as illustrated in FIG. 5, is provided with a longitudinally extended cleaning chamber 1 including an entrance 2 formed in an upper portion thereof. An organic solvent 3, such as trichloroethylene or the like, is reserved or stored in a lower portion of cleaning chamber 1; a heating coil 4 is disposed in organic solvent 3, which is intended to evaporate organic solvent 3 thus generating the vapor. A cooling coil 5 for cooling off and condensing the organic solvent vapor is disposed to surround an intermediate portion of cleaning chamber 1. An elevator 7 is provided for moving a material W, which is ascended by actuation of a cylinder 6, between a position facing entrance 2 and a position just above reserved or stored organic solvent 3.

Entrance 2 is equipped with a door 8 and is also placed between a skid rail 9 and a roller conveyor 10 which cooperate to guide material W. Pushers 11*a*, 11*b* carry material W in and out of cleaning chamber 1. A liquid receptacle 12 is disposed underneath cooling coil 5, and a separator 13, which collects liquid from receptacle 12, eliminates impurities from and returns liquid into cleaning chamber 1. Also provided is a thermometer 14, a temperature sensor 15 for detecting a temperature of organic solvent 3, and a valve 16 interposed in heating coil 4.

In such an arrangement, organic solvent 3 is heated up beforehand by heating coil 4, and cleaning chamber 1 is filled with organic solvent vapor. Elevator 7, which is in an ascended position, receives material W. Subsequently, elevator 7 is lowered by actuation of cylinder 6, at which time organic solvent vapor comes in contact with a cool surface of material W and thereby is condensed. Fats and oils which are stuck to a surface of material W are cleaned off by condensed organic solvent, thus purifying the surface of material W. Meanwhile, a refrigerant carrier always flows through cooling coil 5; and vapor with which an upper portion of cleaning chamber 1 is filled is so cooled down as to be condensed by means of cooling coil 5. Resultant liquid is collected in liquid receptacle 12, and is then transferred back through separator 13 to a lower portion of cleaning chamber 1. The moment the cleaning operation is finished, elevator 7 rises, and the material W is carried out of cleaning chamber 1 by operating exit pusher 11*b*, thus completing one cleaning cycle.

In the above-described cleaning apparatus, however, a space available for carrying material W in and out of the upper portion of the cleaning chamber 1 must be prepared. In addition, in order to prevent vapor from volatilizing (leaking or being lost) to the outside via this space, a position in which cooling coil 5 is disposed must gradually be raised. Cleaning chamber 1 inevitably increases in its total height. Since it is necessary to raise material W with elevator 7, there is no choice but to enlarge the inside diameter of cleaning chamber 1 inclusive of space for installing cooling coil 5.

For this reason, cleaning chamber 1 as a whole becomes considerably large in size and hence costs of manufacturing the apparatus, which involves formation of a pit P, grow. Organic solvent used for a cleaning operation must constantly be evaporated, which necessitates a large amount of energy for heating. Undesirably, a vast volume of such energy and a large capacity cleaning chamber combine to bring about still higher running costs. Furthermore, cooling coil 5 must be disposed outside elevator 7 which needs a large space, so that a distance therebetween is extended. This causes a drop in efficiency in collecting organic solvent vapor. Consequently, vapor losses by volatilization increase. Problems then arise: a working environment around the cleaning chamber deteriorates and wasteful consumption of organic solvent increases.

SUMMARY OF THE INVENTION

A primary object of the present invention which obviates the above-described problems is to provide an organic solvent cleaning apparatus that is capable of reducing the size of the cleaning chamber in order to decrease both equipment costs and running costs, and of improving efficiency in collecting organic solvent vapor.

Another object of the invention is to provide, in the organic solvent cleaning apparatus, a vertically movable cover which in its descended position surrounds the material to be cleaned, and which forms a seal at its lower end to prevent supplied vapor from leaking out.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, an improved organic solvent cleaning apparatus is disclosed comprising a cleaning chamber adapted to be rendered full of an organic solvent vapor to effect a cleaning operation, the cleaning chamber having an entrance formed in a side portion thereof; a door mounted at the entrance of the cleaning chamber operable to hermetically seal the cleaning chamber; vapor supply means in the cleaning chamber for supplying the vapor only during the cleaning operation; and vapor collecting means in the cleaning chamber for collecting the vapor subsequent to the cleaning operation.

According to the present invention, the cleaning chamber may be arranged to have a double-door by forming an auxiliary chamber at the entrance. In this case, a cooling coil also is disposed in the auxiliary chamber. This arrangement aims at completely preventing organic solvent vapor from volatilizing or leaking outside. The above-mentioned entrance may be used in common as an inlet and an outlet, or may be so formed as to be separated into an inlet and an outlet.

Provided that sufficient organic solvent vapor is supplied during a cleaning operation, the configuration of the vapor supplying means is not particularly limited. The vapor supplying means may be formed from the following devices. In one type, for instance, a reserving or storage chamber for the organic solvent is integrally formed beneath a cleaning chamber; and a vapor generator consisting of a sectionally U-shaped solvent receptacle which has a winding configuration and a heating coil disposed in this receptacle is installed just above an organic solvent reserving or storage portion of the reserving or storage chamber. Organic solvent is fed into the foregoing receptacle; and a required amount of vapor is generated during a cleaning operation by using the heating coil's heat. Another type of apparatus is arranged such that a vapor generator is provided separately from a cleaning chamber and the required amount of vapor can be fed into the cleaning chamber when a cleaning operation is being carried on.

The vapor collecting means may include a cooling coil which is either fixedly disposed in a cleaning chamber or movably disposed therein. Where the cooling coil is movably disposed, for example, a suspension board that is moved up and down by a cylinder is installed on an upper portion of the cleaning chamber. From this suspension board there is suspended a cooling coil capable of covering almost half of the cleaning chamber in its vertical direction; and the suspension board may be lowered as occasion arises. This vapor collecting means can be formed from an independent apparatus inclusive of a suction unit linked to the upper portion of a cooling chamber. In this type, the independent apparatus has a cooling unit capable of cooling and condensing organic solvent vapor.

The accompanying drawings, which are incorporated in and constitute a part of this specification, illustrate embodiments of the invention and, together with the description, serve to explain the principles of the invention.

DETAILED DESCRIPTION OF THE PREFERRED EMBODIMENTS

Figure 1:
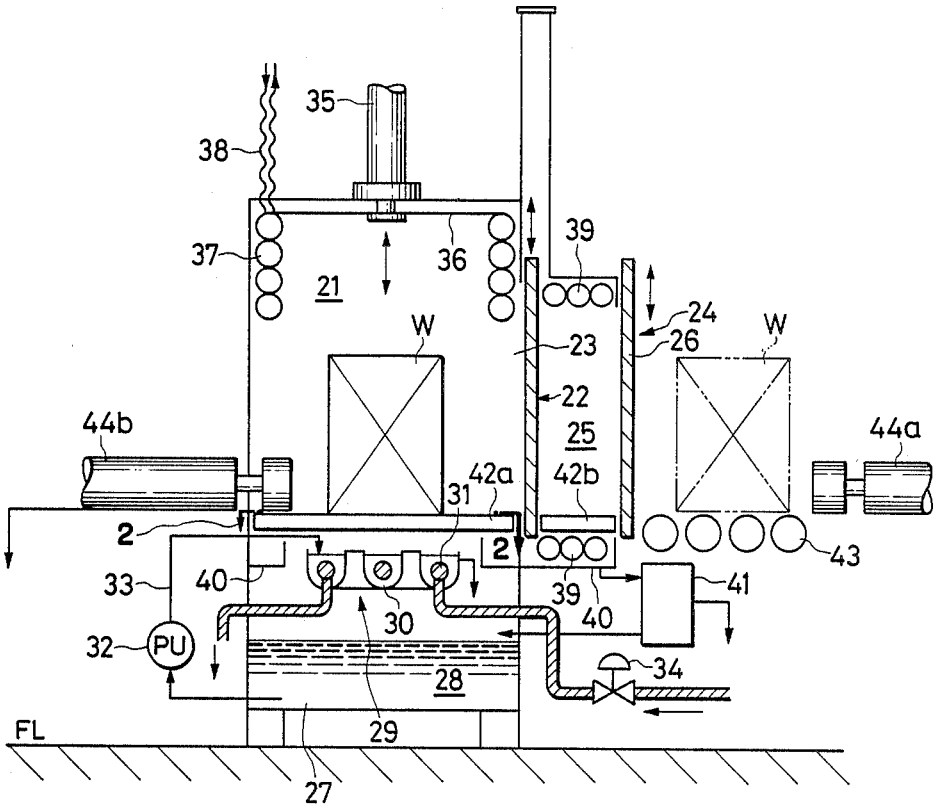
FIG. 1 is a schematic diagram showing one embodiment of an organic solvent cleaning apparatus according to the present invention.
Figure 2:
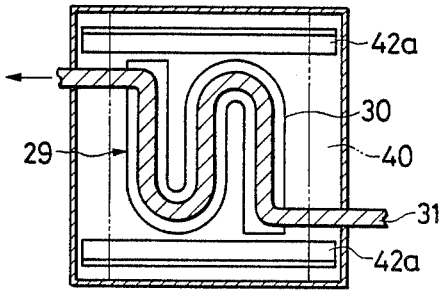
FIG. 2 is a fragmentary sectional diagramatic view of the organic solvent cleaning apparatus of FIG. 1 taken on line 2—2 and looking in the direction of the arrows.

In FIGS. 1 and 2, there is illustrated a cleaning chamber 21, one side portion of which is formed with an entrance 22, and a door 23 so installed at entrance 22 as to be openable and closable. In cleaning chamber 21, an auxiliary chamber 25 having an auxiliary entrance 24 is provided, facing entrance 22. An auxiliary door 26 is likewise so installed at this auxiliary entrance 24 as to be openable and closable. A reserving or storage chamber 28 for an organic solvent 27 is integrally formed in a lower portion of cleaning chamber 21. Above this reserving chamber 28 is disposed a vapor generator 29.

Vapor generator 29 is equipped with a receptacle 30. A sectionally U-shaped tube, whose upper portion is open, together with a heating coil 31 extends in this receptacle 30. Organic solvent 27 accumulated in reserving or storage chamber 28 is fed through a pipe 33 into receptacle 30 by actuation of a pump 32. A heating medium, e.g., vapor, is supplied from a heating source (not illustrated) to heating coil 31 by opening a valve 34 (an electromagnetic valve). Receptacle 30 is formed with enough organic solvent storage space to generate vapor necessary for a detergent operation, which will be mentioned later. Organic solvent which overflows is brought back into reserving chamber 28.

An upper portion of cleaning chamber 21 is provided with a suspension board 36 which is raised and lowered vertically by a cylinder 35. A cooling coil 37 which constitutes a vapor collecting means is suspended from this suspension board 36. Cooling coil 37 is so disposed along an inner surface of cleaning chamber 21 as to cover nearly an upper half of this chamber. A refrigerant carrier is supplied from a cooling/heating source (not illustrated) through a pipe 38 into cooling coil 37. Cooling coils 39 similar to coil 37 are fixedly disposed in upper and lower portions of an auxiliary chamber 25. A liquid receiving member 40 is provided at a boundary between cleaning chamber 21 and reserving chamber 28. Organic solvent collected in this liquid receiving member 40, which will be described later, returns via separator 41, installed outside cleaning chamber 21, to reserving chamber 28. Skid rails **42*a*, 42b for retaining material W are spanned over bottom portions of cleaning chamber 21 and auxiliary chamber 25. A carrying means, for example, a roller conveyor 43, is so provided outside auxiliary chamber 25 as to be flush with skid rails 42*a*, 42*b*. An entrance pusher 44*a* is disposed close to an upper portion of roller conveyor 43; and an exit pusher 44*b* is disposed close to an upper portion of skid rail 42*a* provided in cleaning chamber 21. With this arrangement, material W can be carried in and out of cleaning chamber 21, by pushers 44*a* and 44*b* respectively, via skid rail 42*a***.

In the cleaning apparatus described above, operations of individual components are controlled as a whole by a control unit (not illustrated).

Figure 3:
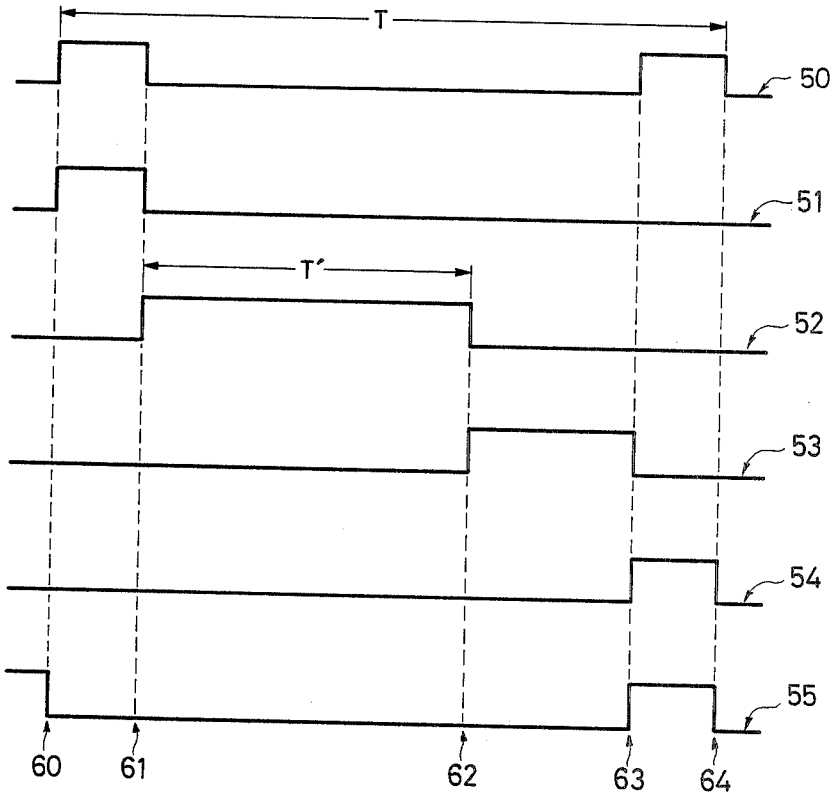
FIG. 3 is a timing cycle diagram showing stages of operation of the organic solvent cleaning apparatus of FIG. 1.

In FIG. 3, operation of an entire cycle is represented by time T, which equals approximately 2.5 seconds and extends from time 60 to time 64. Operation of door 23 and auxiliary door 26 is represented by line 50, both doors opening at time 60 and closing at time 61, and both doors again opening at time 63 and again closing at time 64. Operation of entrance pusher 44*a* is represented by line 51, moving forward at time 60 and moving backward at time 61. Operation of electromagnetic valve 34 is represented by line 52, opening at time 61 and closing at time 62. Cleaning time is represented by time T', which equals approximately 1 second and extends from time 61 to time 62. Operation of cylinder 35 is represented by line 53, going down at time 62 and going up at time 63. Operation of exit pusher 44*b* is represented by line 54, moving forward at time 63 and moving backward at time 64. Operation of pump 32 is represented by line 55, in operation at time 63 and stopped at time 64.

A functioning of the cleaning apparatus as described above now will be described with reference to FIG. 1 and to the cyclic diagram of FIG. 3.

In performing a cleaning operation, to start with, door 23 and auxiliary door 26 are opened, and at the same time material W is transferred, by actuating carry-in pusher 44*a*, from roller conveyor 43 via skid rail 42*b* provided in auxiliary chamber 25 onto skid rail 42*a* laid within cleaning chamber 21. At this time, a predetermined amount of organic solvent 27 is accumulated in receptacle 30 of vapor generator 29. Meanwhile, as illustrated in FIG. 1, a refrigerant carrier flows through cooling coil 37 disposed at the upper end of chamber 21.

Soon after material W has been completely conveyed into chamber 21, door 23 and auxiliary door 26 are closed. By opening electromagnetic valve 34 following this step, a heating medium flows through heating coil 31 causing organic solvent to begin evaporating quickly. Cleaning chamber 21 immediately becomes full of vapor, with which material W is cleaned.

At this time, vapor which stagnates in an upper portion of cleaning chamber 21 is cooled down and condensed by means of cooling coil 37. Subsequently, a resultant liquid is collected in liquid receiving member 40. Vapor which partly branched off into auxiliary chamber 25 is also cooled down by a cooling coil 39 disposed therein; and liquid is likewise collected in liquid receiving member 40.

Upon completion of a cleaning operation, suspension board 36 is lowered by actuation of cylinder 35. Because of this process, material W is encompassed by cooling coil 37, thereby vapor surpluses are collected in the vicinity thereof. In other words, all vapor stagnant in cleaning chamber 21 is collected because of a lowering of cooling coil 37. After collection of the vapor has been completed, door 23 and auxiliary door 26 are opened once again. Material W is carried out of cleaning chamber 21 by operating exit pusher 44*b*, thus finishing a series or cycle of a cleaning operation.

As described above, after carrying material W into cleaning chamber 21, organic solvent vapor is generated; vapor within cleaning chamber 21 is completely collected by means of cooling coil 37; and material W is carried out therefrom. Hence, there is no organic solvent vapor loss (volatilization) to the outside via door 23 and auxiliary door 26. Consequently, extra spaces needed for carrying material W in and out of a cleaning chamber and for collecting vapor can be saved. Moreover, it is feasible to transfer material directly to a lower portion of cleaning chamber 21, and an elevator which has conventionally been used can therefore be omitted. An inside diameter of cleaning chamber 21 can be reduced in proportion to that saved space.

In addition, it is possible to supply an amount of organic solvent which is an irreducible minimum amount necessary for performing a cleaning operation. By virtue of a rational design of a vapor generator which increases a contact area of organic solvent 27 with respect to heating coil 30, it is feasible not only to decrease greatly consumption of thermal energy required for generating vapor but also to generate vapor quickly.

Cooling coil 37 can be brought close to material W because of the elimination of the conventional elevator, also, because of a vertical movement of cooling coil 37, collection of vapor is facilitated.

Figure 5:
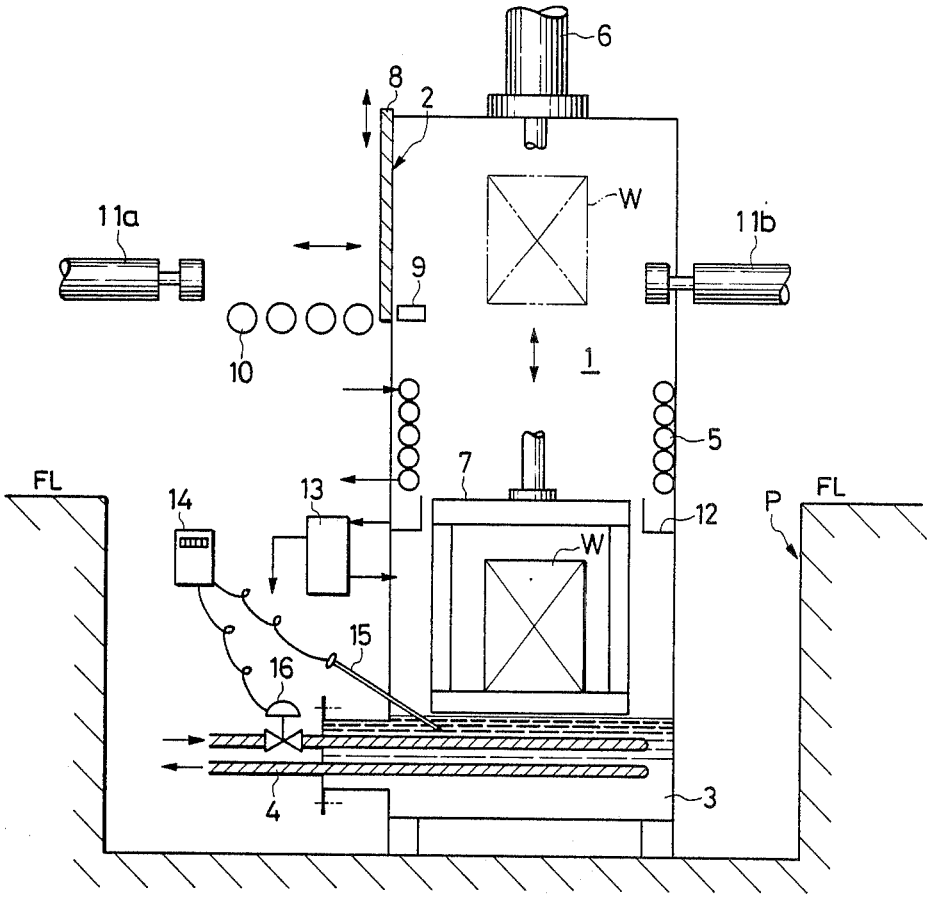
FIG. 5 PRIOR ART
FIG. 5 is a schematic diagram showing a conventional organic solvent cleaning apparatus.

These two advantages, transferring material W directly into cleaning chamber 21 and readily collecting vapor, make it possible to gradually diminish a cyclic time of cleaning. As illustrated in the cyclic diagram of FIG. 3, to be specific, a cleaning time T' of vapor amounts to approximately 1 second, long enough to treat a material to be cleaned which has a unit weight of 100 kg (i.e., a gross weight of 180 kg including a jig weight of 80 kg). A total treatment time T, inclusive of time needed for carrying material in and out of the cleaning chamber, is about 2.5 seconds. This value is almost half as small as the time in which the conventional cleaning apparatus shown in FIG. 5 treats the same material.

In the above-described embodiment, cooling coil 37 is so disposed that it is capable of moving up and down. Instead of this placement, the cooling coil may be fixed so that it covers an entire inside area of cleaning chamber 21. In this case, a cooling coil is divided plurally and vertically. For instance, refrigerant carriers constantly flow through upper cooling coils and, immediately after completing a cleaning operation, refrigerant carriers run through lower cooling coils. As a matter of course, after finishing a cleaning, refrigerant carriers may flow through cooling coils subsuming cooling coil 37 used in the above-mentioned embodiment.

According to the present invention, it is permissible that separate vapor collecting means including a suction unit and a cooling unit which are linked to the cleaning chamber be provided in place of cooling coils. In such a case, the vapor collecting means is operated at the moment of completion of the cleaning.

Figure 4:
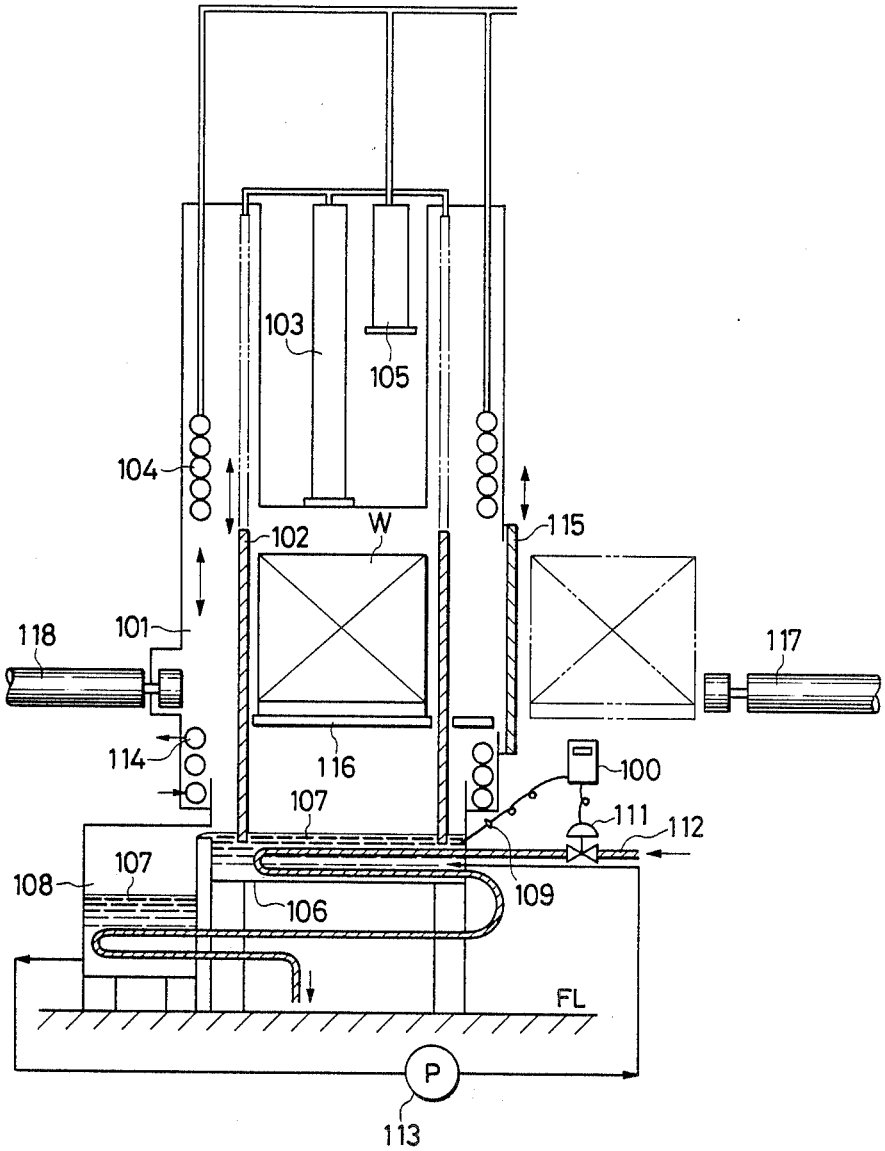
FIG. 4 is a schematic diagram of another embodiment of an organic solvent cleaning apparatus according to the present invention.

FIG. 4 illustrates another embodiment of the present invention, which will be described as follows.

A reserving or storage chamber 106 for storing an organic solvent 107 such as trichloroethylene is provided at a lower portion of a cleaning chamber 101. Storage chamber 106 is arranged such that when organic solvent 107 overflows, overflowed solvent is led into an overflow tank 108. To this overflow tank 108 is connected a solvent pump 113 for feeding out organic solvent 107 to storage chamber 106. Heating coils 112, through which a thermal medium is made to flow for evaportaing organic solvent 107, are installed both in storage chamber 106 and in overflow tank 108. A stationary cooling coil 114, intended to collect liquid obtained by cooling and condensing organic solvent vapor, is fixedly disposed along an inside wall of cleaning chamber 101 above storage chamber 106. One side of cleaning chamber 101 is formed with an entrance door 115. A skid rail 116, designed for guiding material W to a position above storage chamber 106, is disposed inside of door 115. Pushers 117, 118 carry material W in and out of cleaning chamber 101.

In a middle of cleaning chamber 101 is a cover 102 which is raised and lowered by means of a cover cylinder 103. When lowered, this cover 102 surrounds material W. A movable cooling coil 104 which is moved vertically by cooling cylinder 105 is suspended outside of cover 102. There is provided a thermometer 100, a thermoelectric couple 109, and a valve 111 which is interposed in a heating coil 112.

An operation of this organic solvent cleaning apparatus now will be explained with reference to FIG. 4.

Organic solvent 107 is accumulated in storage chamber 106. From overflow tank 108, solvent pump 113 pumps organic solvent 107 little by little into chamber 106. Extra organic solvent 107 which overflows from storage chamber 106 flows into overflow tank 108. In this way, organic solvent 107 circulates. When material W does not undergo a cleaning operation, thermoelectric couple 109 previously provided in organic solvent 107 senses a temperature thereof. A thermal medium flowing through heating coil 112 is controlled by thermometer 100 and valve 111; and a temperature of organic solvent 107 is controlled so that it is at a boiling point or less. Vapor generated at that time is cooled down and is instantly condensed by cooling coil 114 fixedly disposed above reserving chamber 107, thereby collecting liquid obtained in this manner. Door 115 formed in a side portion of cleaning chamber 101 is opened; material W is pushed forward by pusher 117 and is shifted by skid rail 116 to a central position of cleaning chamber 101; and door 115 is then closed. Cover 102 is lowered by cover cylinder 103, whereby material W is encompassed by cover 102. A lower end of cover 102 dips into organic solvent 107 in reserving chamber 106, thus creating a seal. Organic solvent 107 accumulated in reserving chamber 106 is instantaneously heated up to a boiling point by means of heating coil 112, thereby evaporating organic solvent 107. Subsequently, cover 102 is filled with vapor, in which condition material W is cleaned. Generally speaking, since an organic solvent employed for cleaning has a high specific gravity, even when an upper end of cover 102 is open, vapor does not volatilize very much from that opening. However, vapor which does volatilize from cover 102 is cooled down and condensed by movable cooling coil 104 and stationary cooling coil 114. Resultant liquid is then collected. During a cleaning operation, where movable cooling coil 104 is positioned in a vicinity of an upper end of cover 102, it is feasible to cool down vapor which volatilizes from cover 102 with high efficiency.

Upon completion of cleaning, the temperature of organic solvent 107 in reserving chamber 106 is decreased to a boiling point or less by controlling heating coil 112. Movable cooling coil 104 is lowered close to skid rail 116 by cooling coil cylinder 105; and vapor which has volatilized due to a raising of cover 102 is cooled down and condensed both by already-lowered movable cooling coil 104 and by stationary cooling coil 114. Liquid is then collected. Movable cooling coil 104 is raised, and door 115 is opened. Then material W is carried out, pushed by pusher 118.

It is to be noted that cleaning chamber 101 can be slightly higher than material W except for a portion in which movable cooling coil 104 and cover 102 are accommodated in their raised positions. Hence, cleaning chamber 101 can be reduced in size.

In this embodiment, as described above, with cover 102 and movable cooling coil 104, there is almost no volatilization of organic solvent vapor even with a single door.

Organic solvent cleaning apparatus according to the present invention yields the following effects. A vapor supply means is capable of supplying organic solvent vapor only during a cleaning operation, and it is therefore feasible to save the extra spaces for carrying material in and out of a cleaning chamber as well as for collecting vapor. By virtue of this arrangement, a cleaning chamber can be reduced considerably in height. It is possible to carry material directly in and out of an entrance formed in a side portion of a cleaning chamber and hence a conventional elevator becomes unnecessary. Consequently, an inside diameter of the cleaning chamber can be diminished to that extent.

Furthermore, organic solvent vapor is fed into a reduced-in-sized cleaning chamber only during a cleaning operation, which brings about a decrease in a quantity of thermal energy required for generating vapor. There is an increased degree of freedom in installing a vapor collecting means owing to elimination of an elevator, thereby facilitating a collection of vapor. In addition, material to be cleaned can be carried directly in and out of the cleaning chamber. These advantages are combined to enable a cyclic time of cleaning to be shortened very much. Moreover, it is feasible to reduce equipment cost and to improve maintainability on account of a reduction in size of a cleaning chamber and an elimination of an elevator.

As the foregoing description makes clear, an organic solvent cleaning apparatus according to the present invention, which is equipped with a cover that is vertically movable within the cleaning chamber, has additional advantages: by performing the cleaning operation within the cover it is feasible to decrease not only consumption of organic solvent and energy but also vapor loss; the cleaning chamber can be reduced in size; and a problem caused by vapor loss does not arise even when an entrance is formed in a side portion of the cleaning chamber.

It will be apparent to those of ordinary skill in the art that various modifications and variations can be made to the above-described embodiments without departing from the scope of the appended claims and then equivalents.

We claim:

1. An organic solvent cleaning apparatus comprising:

a cleaning chamber adapted to be rendered full of an organic solvent vapor to effect a cleaning operation, the cleaning chamber having an entrance formed in a side portion thereof;

a door mounted at the entrance of the cleaning chamber operable between upper and lower positions;

means for lowering the door to immerse a portion of the door in organic solvent for hermetically sealing the cleaning chamber during a cleaning operation;

vapor supply means in the cleaning chamber for supplying the vapor only during the cleaning operation; and vapor collecting means in the cleaning chamber for collecting the vapor subsequent to the cleaning operation.

2. An organic solvent cleaning apparatus according to claim 1 further comprising an auxiliary chamber covering the entrance of the cleaning chamber;

cooling coils fixedly disposed in the auxiliary chamber;

the auxiliary chamber having an entrance facing the cleaning chamber entrance;

an auxiliary door mounted to open and close the auxiliary entrance; and means disposed in the cleaning chamber and in the auxiliary chamber, for guiding a material to be cleaned through the auxiliary chamber and into the cleaning chamber.

3. An organic solvent cleaning apparatus according to claim 1 wherein the vapor collecting means includes a cooling coil movably disposed within the cleaning chamber.

4. An organic solvent cleaning apparatus comprising:
a cleaning chamber adapted to be rendered full of an organic solvent vapor to effect a cleaning operation, the cleaning chamber having
an entrance formed in a side portion thereof;
a door mounted at the entrance of the cleaning chamber operable to hermetically seal the cleaning chamber;
vapor supply means in the cleaning chamber for supplying the vapor only during the cleaning operation, wherein the vapor supply means includes
a vapor generator having a sectionally U-shaped solvent receptacle in a winding configuration, and
a heating coil, for generating vapor from the solvent in the U-shaped receptacle, disposed in the U-shaped receptacle; and
vapor collecting means in the cleaning chamber for collecting the vapor subsequent to the cleaning operation.

5. An organic solvent cleaning apparatus comprising:
a cleaning chamber adapted to be rendered full of an organic solvent vapor to effect a cleaning operation, the cleaning chamber having
an entrance formed in a side portion thereof;
a door mounted at the entrance of the cleaning chamber operable to hermetically seal the cleaning chamber;
vapor supply means in the cleaning chamber for supplying the vapor only during the cleaning operation wherein the vapor supply means includes means for flowing the solvent into separate chambers and means for generating vapor from one of the separate chambers; and
vapor collecting means in the cleaning chamber for collecting the vapor subsequent to the cleaning operation.

6. An organic solvent cleaning apparatus comprising:
a closed cleaning chamber having sidewalls, at lest one of the sidewalls having an entrance therein;
a door operable between upper and lower positions to close the entrance;
means for operating the door to the lower position to immerse a portion of the door in organic solvent for hermetically sealing the cleaning chamber during a cleaning operation;
means for supplying organic solvent vapor at a commencement of the cleaning operation;
means for terminating the supply of organic solvent vapor at a conclusion of the cleaning operation; and
means for collecting from the cleaning chamber, subsequent to the conclusion of the cleaning operation, the vapor supplied between the commencement and the conclusion of the cleaning operation.

7. An organic solvent cleaning apparatus comprising:
a cleaning chamber having sidewalls;
a storage chamber at one end of the sidewalls for storing organic solvent;
one sidewall having an entrance therein above the storage chamber for admitting material to be cleaned;
vapor supply means disposed in the storage chamber for supplying an organic solvent vapor to material in the cleaning chamber;
means to confine the supplied vapor to an area surrounding the material to be cleaned wherein the confining means includes a cover having sidewalls depending toward the storage chamber; and means for lowering the cover toward the storage chamber to immerse a portion of the sidewalls in organic solvent for sealing the material to be cleaned; and
vapor collecting means for collecting the vapor subsequent to a cleaning operation.

8. An organic solvent cleaning apparatus according to claim 7 wherein the vapor collecting means includes means for positioning a cooling coil surrounding the confined area for condensing the vapor subsequent to the cleaning operation.

9. An organic solvent cleaning apparatus comprising:
a cleaning chamber having sidewalls;
a storage chamber at one end of the sidewalls for storing organic solvent;
one sidewall having an entrance therein above the storage chamber for admitting material to be cleaned;
vapor supply means disposed in the storage chamber for supplying an organic solvent vapor to material in the cleaning chamber wherein the vapor supply means includes means for flowing the solvent into separate chambers and means for generating vapor from the solvent in one of the separate chambers;
means for confine the supplied vapor to an area surrounding the material to be cleaned; and
vapor collecting means for collecting the vapor subsequent to a cleaning operation.

10. An organic solvent cleaning apparatus comprising:
a cleaning chamber having sidewalls;
a storage chamber at one end of the sidewalls for storing organic solvent;
one sidewall having an entrance therein above the storage chamber for admitting material to be cleaned;
vapor supply means disposed in the storage chamber for supplying an organic solvent vapor to material in the cleaning chamber wherein the vapor supply means includes
a vapor generator having a sectionally U-shaped solvent receptacle in a winding configuration, and
a heating coil, for generating vapor from the solvent in the U-shaped receptacle, disposed in the U-shaped receptacle;
means to confine the supplied vapor to an area surrounding the material to be cleaned; and
vapor collecting means for collecting the vapor subsequent to a cleaning operation.

* * * * *

UNITED STATES PATENT AND TRADEMARK OFFICE

CERTIFICATE OF CORRECTION

PATENT NO. : 4,800,362

DATED : January 24, 1989

INVENTOR(S) : Noboru Sasaki, Haruki Yamada, Yoshiaki Onchi and Kazuya Horio

It is certified that error appears in the above-identified patent and that said Letters Patent is hereby corrected as shown below:

Column 10, line 38, "for" should read --to--.

Signed and Sealed this

Sixth Day of February, 1990

*Attest:*

JEFFREY M. SAMUELS

*Attesting Officer*

*Acting Commissioner of Patents and Trademarks*